US007614782B2

(12) United States Patent
Hiraya et al.

(10) Patent No.: US 7,614,782 B2
(45) Date of Patent: Nov. 10, 2009

(54) CHRONOGRAPH TIMEPIECE

(75) Inventors: Eiichi Hiraya, Shiojjri (JP); Kazunari Agesawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 11/713,080

(22) Filed: Mar. 2, 2007

(65) Prior Publication Data

US 2007/0206447 A1 Sep. 6, 2007

(30) Foreign Application Priority Data

Mar. 3, 2006 (JP) ..... 2006-057312
Aug. 4, 2006 (JP) ..... 2006-212913

(51) Int. Cl.
*G04F 7/00* (2006.01)

(52) U.S. Cl. ..... 368/106; 368/112

(58) Field of Classification Search ..... 368/101, 368/106, 107, 112
See application file for complete search history.

(56) References Cited

U.S. PATENT DOCUMENTS

| | | | | |
|---|---|---|---|---|
| 5,793,708 | A | 8/1998 | Schmidt et al. | |
| 6,567,345 | B1 | 5/2003 | Furukawa et al. | |
| 2003/0137900 | A1* | 7/2003 | Akahane et al. | 368/110 |
| 2004/0218473 | A1* | 11/2004 | Takahashi et al. | 368/37 |
| 2005/0007888 | A1* | 1/2005 | Jolidon | 368/110 |

FOREIGN PATENT DOCUMENTS

| | | | |
|---|---|---|---|
| CH | 227300 | | 5/1943 |
| CH | 271999 | | 11/1950 |
| JP | S51-114162 | A | 10/1976 |
| JP | H09-178868 | A | 7/1997 |
| JP | H11-187218 | A | 7/1999 |
| JP | 3011371 | B2 | 12/1999 |
| JP | 2000-14716 | A | 5/2000 |
| JP | 2001-208872 | A | 8/2001 |
| JP | 2002-202387 | A | 7/2002 |
| JP | 2004-264036 | A | 9/2004 |

* cited by examiner

*Primary Examiner*—Renee S Luebke
*Assistant Examiner*—Thanh S Phan
(74) *Attorney, Agent, or Firm*—Global IP Counselors, LLP

(57) ABSTRACT

A chronograph watch, which makes it possible to perform accurate zero-reset of a plurality of elapsed time display sections, and to reduce the number of components thus simplifying the structure, can be provided.
Means for Solving the Problem The chronograph watch 1 according to the present invention includes an hour counting wheel 25, a second counting wheel 40, and a minute counting wheel 60 distant from each other in a planar direction, and is provided with a hammer 160 for substantially simultaneously and mechanically zero-resetting the hour counting wheel 25, the second counting wheel 40, and the minute counting wheel 60, the hammer 160 being composed of a hammer body 161 and a minute hammer 170. The hammer body 161 includes a counting wheel operating section 164 and a second counting wheel operating section 165 for zero-resetting the hour counting wheel 25 and the second counting wheel 40, and a minute hammer 170 includes a minute counting wheel operating section 172 for zero-resetting the minute counting wheel 60. The position of the minute counting wheel operating section 172 with respect to the hour counting wheel operating section 164 and the second counting wheel operating section 165 is adjusted by the adjusting shaft of the minute hammer 170.

3 Claims, 8 Drawing Sheets

CHRONOGRAPH TIMEPIECE

TECHNICAL FIELD

The present invention relates to a chronograph watch. In particular, the present invention relates to a zero-reset structure of a plurality of elapsed-time display sections.

BACKGROUND ART

In the past, in a chronograph watch having a normal time display section and an elapsed-time display section (also referred to as a chronograph display section in some cases) for displaying elapsed time, there has been known a chronograph watch having the elapsed-time display section composed of four display sections of a tenth second unit, a second unit, a minute unit, and an hour unit, and provided with four zero-reset levers for zero-resetting the respective display sections (see, for example, Patent Document 1).

Patent Document 1: Japanese Unexamined Patent Publication No. 2000-147167

In such Patent Document 1, since the zero-reset levers corresponding to the respective display sections as described above, it is hardly influenced by the positional variation of each of the display sections and variations of dimensions of the zero-reset levers, and accordingly, zero-resetting of each of the display sections can be performed accurately.

However, since the zero-reset levers corresponding to the respective display sections are provided, and spring members and so on for operating each of the zero-reset levers independently, there is caused a problem that the number of composing parts is increased and the structure becomes complicated.

Further, although it is possible that a number of standards of the shapes of the zero-reset levers are prepared for further reducing the influence of the variations of the dimensions of the zero-reset levers to be suitably selected for assembling out of the standards, deterioration of production efficiency is projected because selection and grading of the standards are required when assembling.

An object of the present invention has the substance of solving the problems described above, and is to provide a chronograph watch allowing accurate zero-reset of a plurality of elapsed time display sections, simplification of the structure by reduction of the number of parts, and enhancement of the production efficiency.

DISCLOSURE OF THE INVENTION

A chronograph watch according to the present invention is a chronograph watch having a movement including a plurality of elapsed time display sections distant from each other in a planar direction, including a single zero-reset member for substantially simultaneously and mechanically zero-resetting the plurality of elapsed time display sections, wherein the zero-reset member includes zero-reset operating sections for zero-resetting respective elapsed time display sections.

Here, the elapsed time display sections denote the chronograph display sections for displaying the time measurement results such as second unit, minute unit, or hour unit in the chronograph watch.

According to the present invention, since the structure is for zero-resetting the elapsed time display section, which is provided a plural number, by a zero-reset member configured as a unit, the number of components can dramatically be reduced in comparison with the structure by the prior art technology described above. Further, since the components for operating the zero-reset member can also reduced, the structure can be simplified, thus the significant cost reduction can be realized.

Further, it is preferable that at least one of the zero-reset operating sections includes an adjusting mechanism for adjusting a position with respect to the corresponding elapsed time display section.

Assuming that the elapsed time display sections include three chronograph display sections for displaying time measurement results such as second unit, minute unit, or hour unit, and the zero-reset is performed by a single zero-reset member, the zero-reset member becomes to have three zero-reset operating sections for zero-resetting each of the chronograph display sections. However, because of the manufacturing variations in dimensions of three chronograph display sections and three zero-reset operating sections, it is conceivable that the zero-reset of the three display sections cannot be completed.

In this case, by providing the adjusting mechanism for adjusting the position to at least one of the zero-reset operating sections, by adjusting in accordance with the positional relationship between another zero-reset operating sections and the respective chronograph display sections, the zero-reset of a plurality of display sections can simultaneously and accurately be performed.

Further, it is preferable that the zero-reset member includes a movable lever having a zero-reset operating section the position of which can be adjusted by the adjusting mechanism, and a zero-reset member body having another zero-reset operating section, the zero-reset member body and the movable lever are fixed to each other by a movable lever fixing screw, the adjusting mechanism includes an eccentric shaft for adjusting a position of the movable lever with respect to the another zero-reset operating section.

By thus configured, the position adjustment of the movable lever can be performed by loosing the movable lever fixing screw, and then, by tightening the movable lever fixing screw, the movable lever and the zero-reset member body can easily be integrated.

Further, since the position adjustment of the movable lever is performed by rotating an eccentric shaft, fine position adjustment can easily be performed.

Further, it is preferable that the zero-reset member includes an elastic member between the zero-reset member body and the movable lever, if the movable lever fixing screw is loosed, a position of the movable lever in a planar direction with respect to the zero-reset member is maintained by elastic force of the elastic member.

It is conceivable that when the fixing screw is loosed for performing the adjustment of the movable lever position, the movable lever becomes free, and the position cannot be determined. Therefore, by providing the elastic member between the zero-reset member body and the movable lever, the movable lever can be maintained in the position by the elastic force of the elastic member after the position adjustment until it is fixed again by tightening the movable lever fixing screw, therefore, the movable lever can be adjusted accurately in the desired position.

Further, in the present invention, it is preferable that taking two zero-reset operating sections disposed outside in both sides directions along a moving direction of the zero-reset member as a reference, the adjusting mechanism is provided to the movable lever disposed between the two zero-reset operating sections.

By thus configured, since the adjusting mechanism is provided to the movable lever positioned between the two zero-reset operating sections disposed on the zero-reset member body described above, the adjusting range by the adjusting mechanism can be smaller, thus the adjusting mechanism itself can be downsized.

Further, it is preferable that the adjusting mechanism and a part of the elapsed time display sections corresponding to the zero-reset operating section provided to the movable lever are disposed so as to be observed from a direction of one of the surfaces of the movement.

Therefore, it is possible that the position adjustment of the zero-reset operating section is performed by the zero-reset member alone or is performed in the middle of assembling the movement, however, it is conceivable that in these cases, the posture is not stabilized and the adjustment operation becomes difficult. Further, it is projected that the adjustment is not sufficient at the completion of the movement because of the dimensional relationship with other components. However, by performing the adjustment in the final assembling process of the movement, the posture is stabilized to make the adjustment operation easy, and further, the adjustment including influence of other components can be performed.

DESCRIPTION OF REFERENCE NUMERALS AND SIGNS

1: chronograph watch, 25: hour counting wheel, 40: second counting wheel, 60: minute counting wheel, 160: hammer, 164: hour counting wheel operating section, 165: second counting wheel operating section, 167: adjusting shaft, 170: minute hammer, 172: minute counting wheel operating section.

BEST MODE FOR CARRYING OUT THE INVENTION

Some embodiments of the invention will hereinafter be explained with reference to the accompanying drawings.

Figure 6:
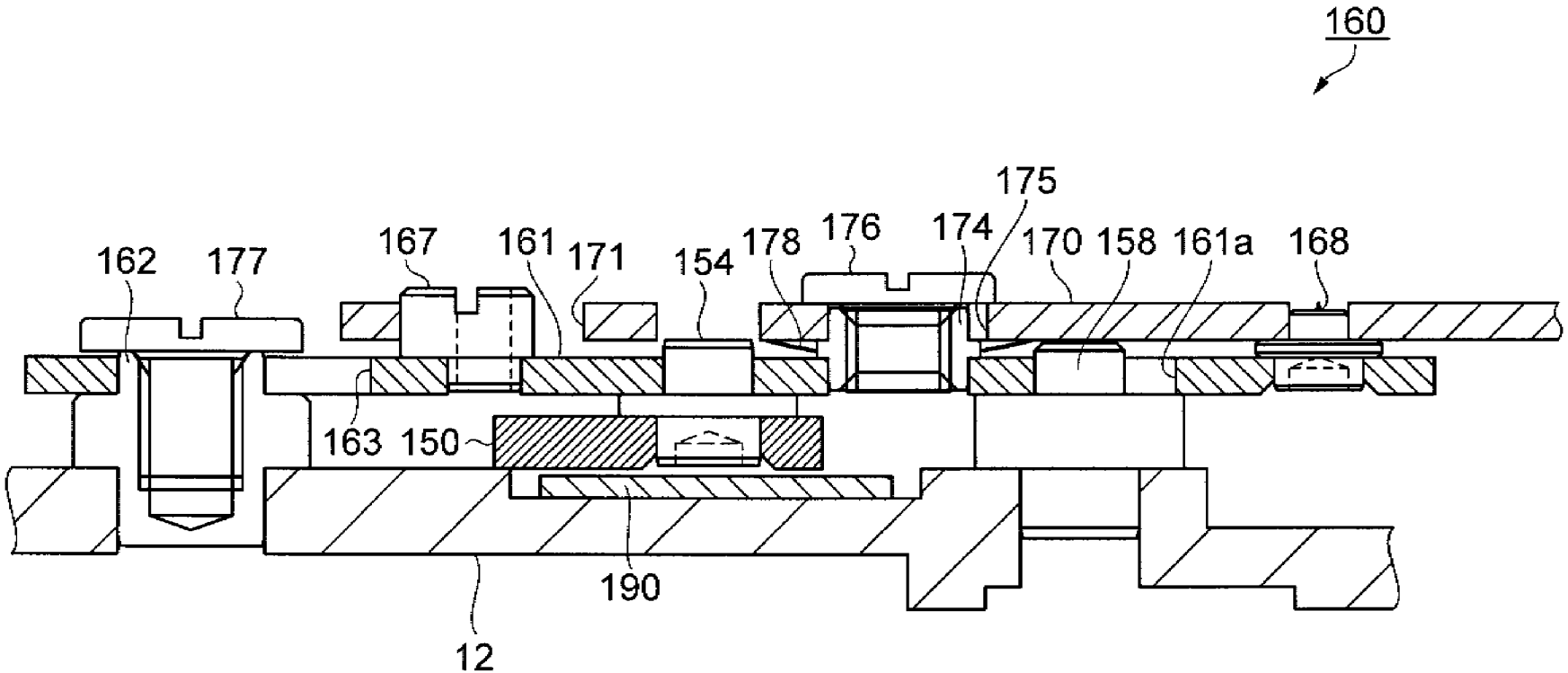
FIG. 6 is a partial cross-sectional view showing position adjustment of the minute hammer to the hammer body according to the embodiment of the invention.
Figure 7:
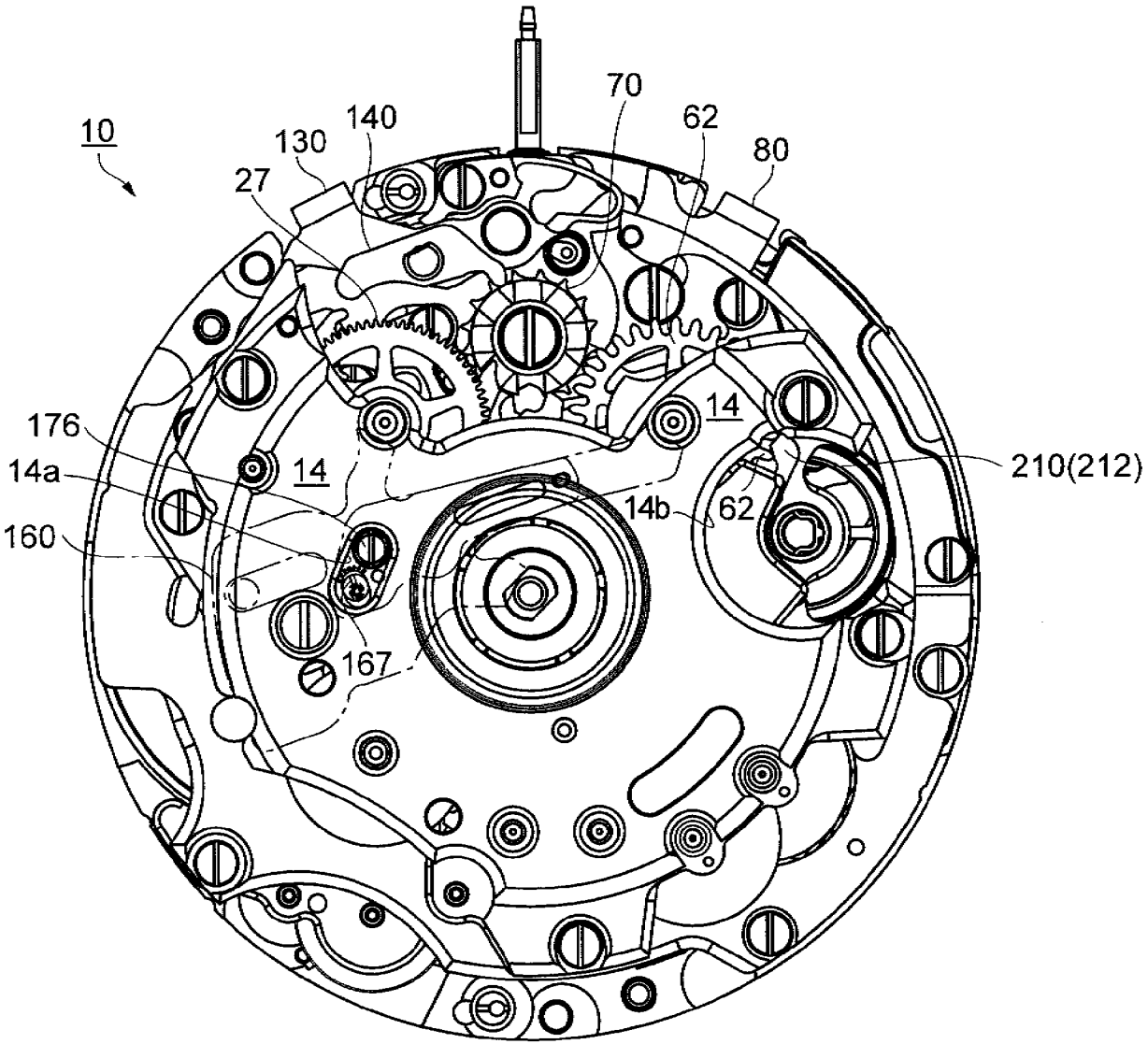
FIG. 7 is an external view of the movement according to the embodiment of the invention.
Figure 8:
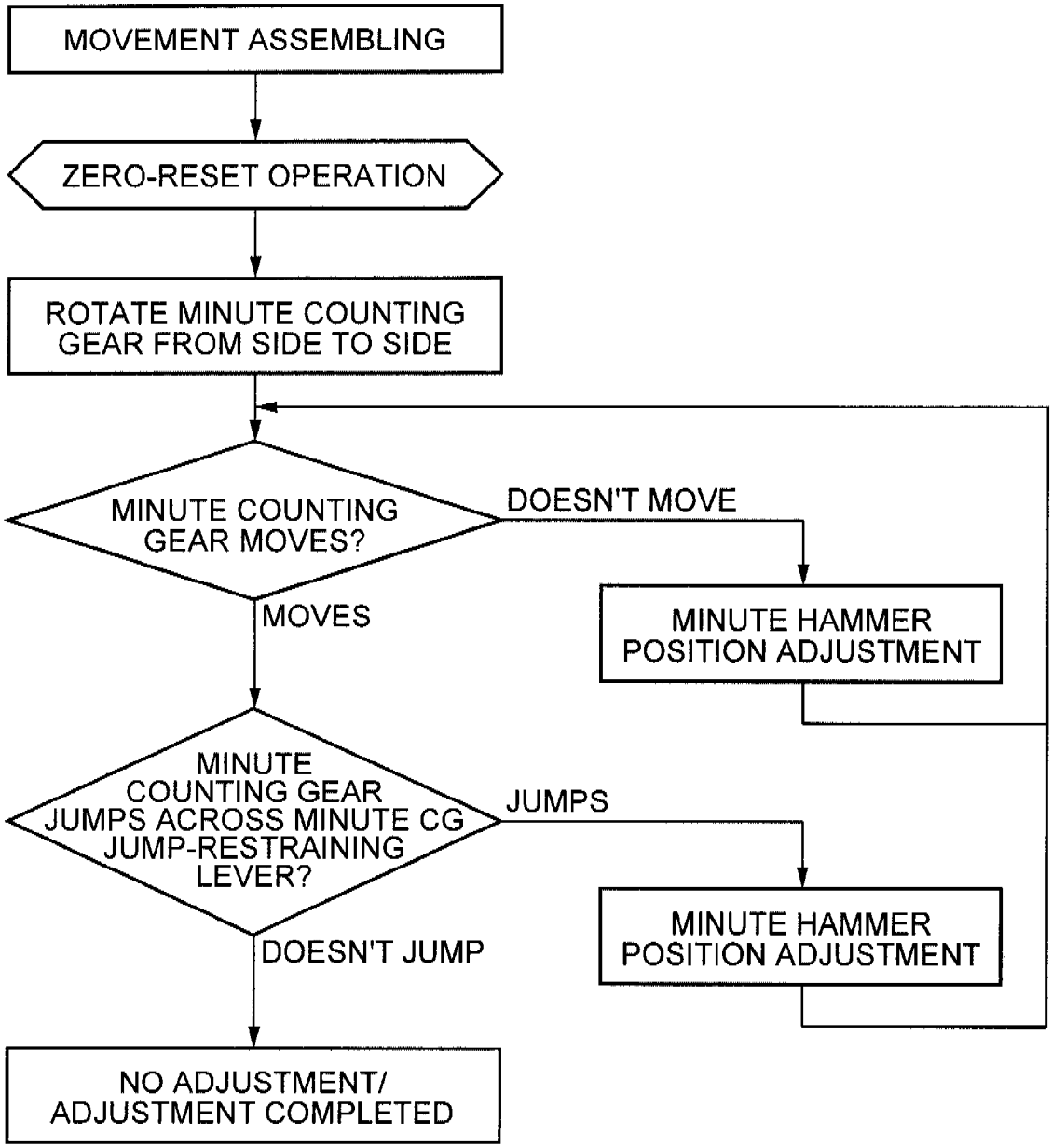
FIG. 8 is an explanatory diagram showing a process of adjusting the position of the minute hammer according to the embodiment of the invention.

FIGS. 1 through 7 show the chronograph watch according to the embodiment of the invention, and FIG. 8 shows a method of adjusting the hammer as a zero-reset member.

Embodiments

Figure 1:
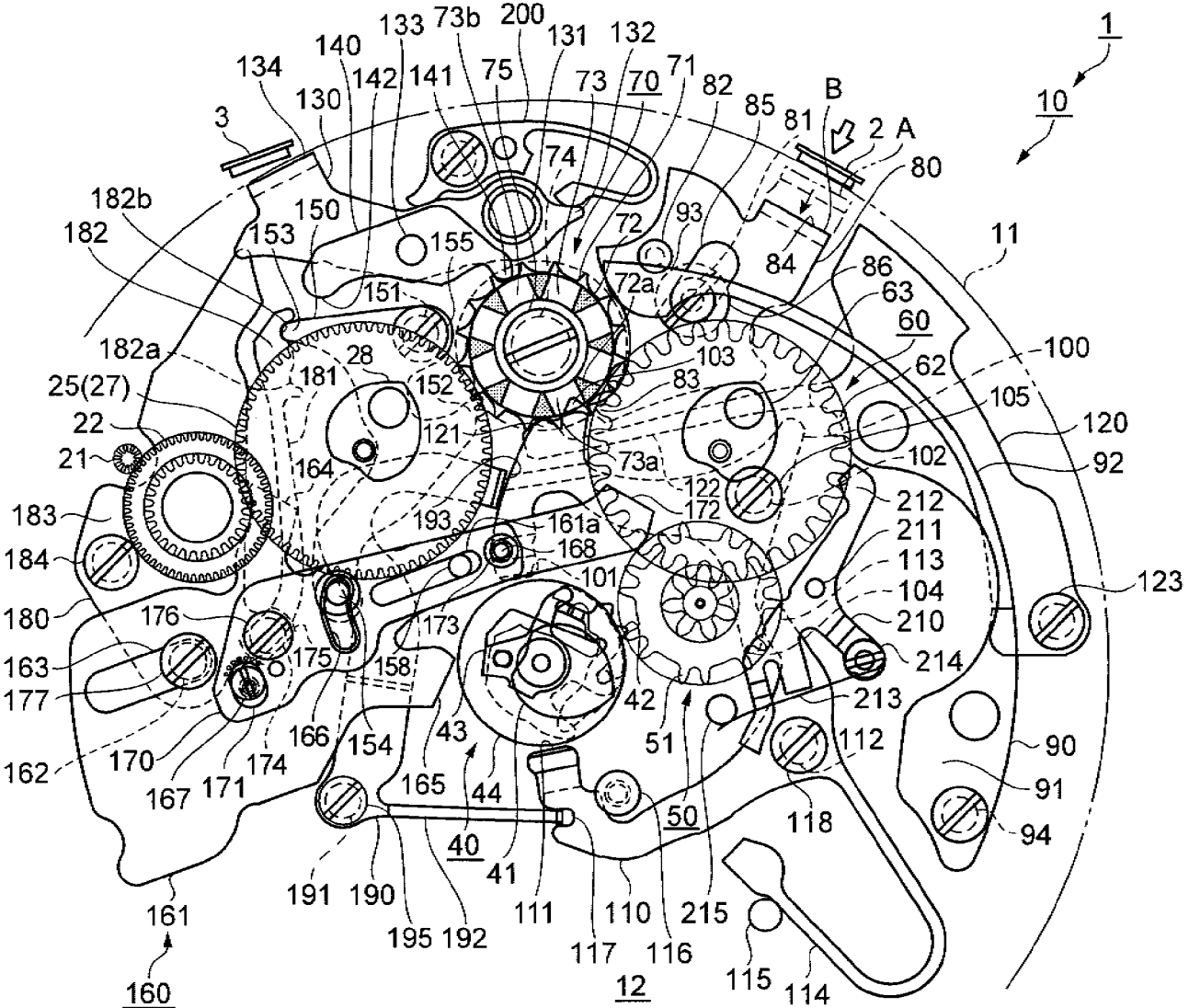
FIG. 1 is a plan view showing a part of a movement of a chronograph watch according to an embodiment of the invention.

FIG. 1 is a plan view showing a part of a movement of a chronograph watch according to an embodiment of the invention. Since the present invention is characterized in the structure for simultaneously, mechanically zero-resetting a plurality of chronograph display sections as an elapsed time display section of the chronograph watch, explanations will be presented focusing on the chronograph mechanism characterizing the invention.

Further, although the zero-reset structure of the present invention can be adopted to any one of a mechanical watch, an electronically controlled mechanical watch, an analog quartz watch, the explanation will be presented in the present embodiment exemplifying an automatic mechanical watch.

Further, as a chronograph display section, the explanation will be presented exemplifying a structure provided with three display sections, namely an hour chronograph display section (hereinafter referred to as an hour CG display section), a minute chronograph display section (hereinafter referred to as a minute CG display section), and a second chronograph display section (hereinafter referred to as a second CG display section).

Figure 2:
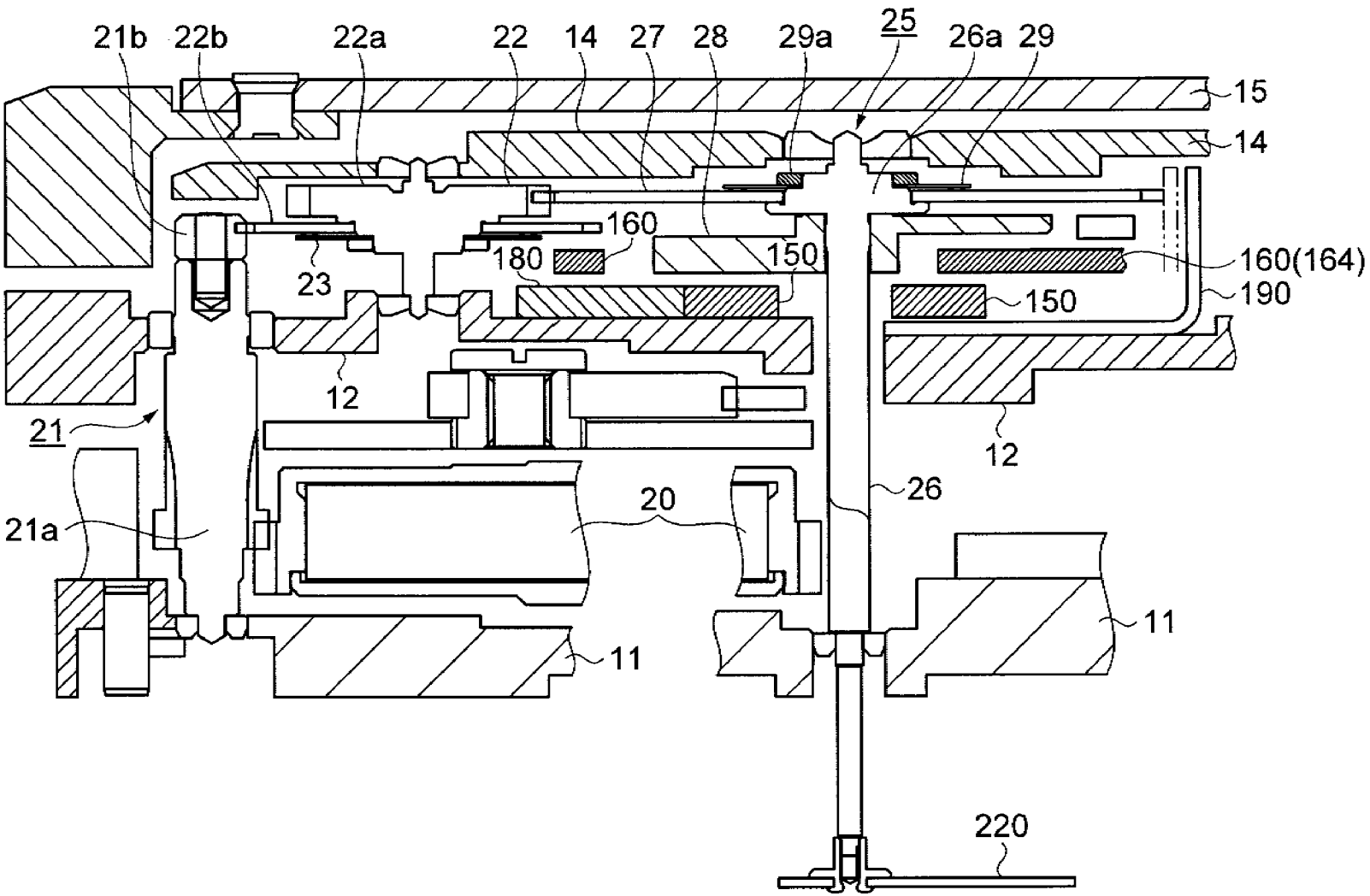
FIG. 2 is a cross-sectional view showing the structure of a counting wheel train according to the embodiment of the invention.
Figure 3:
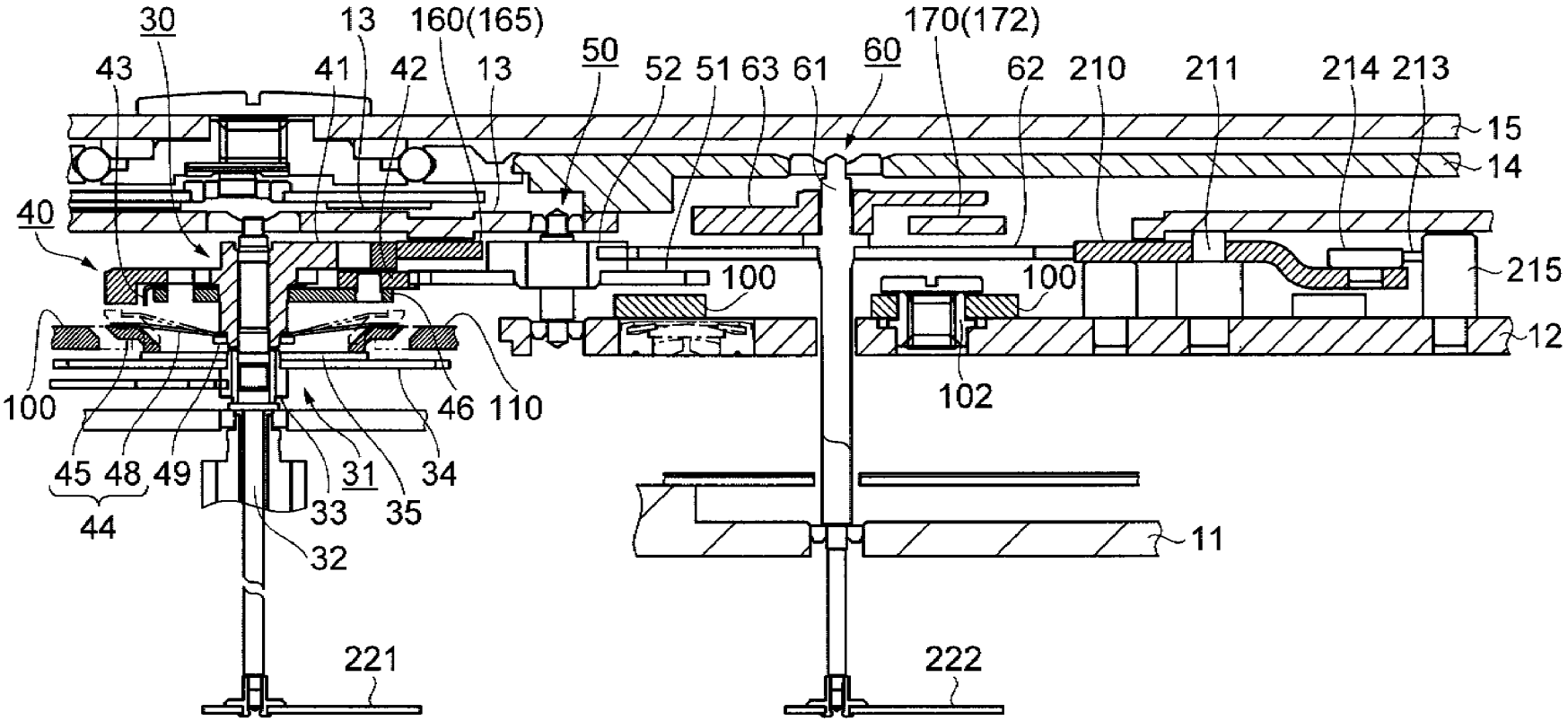
FIG. 3 is a cross-sectional view showing the structure of a second counting wheel train and a minute counting wheel train according to the embodiment of the invention.

FIG. 1 is a plan view showing a chronograph mechanism of a movement 10 in the chronograph watch 1 according to the present embodiment, FIG. 2 is a cross-sectional view showing the structure of the hour CG display section, and FIG. 3 is a partial cross-sectional view showing the structure of the second CG display section and the minute CG display section. FIG. 1 shows a starting state of chronograph measurement.

The chronograph mechanism of the present embodiment is composed of four mechanisms as a basic configuration, namely a column wheel mechanism for controlling start, stop, and zero-reset states of the chronograph, an operating mechanism for controlling start and stop operations, a zero-reset mechanism for controlling the zero-reset operation, and a chronograph displaying mechanism.

The column wheel mechanism is composed of a column wheel 70, a column wheel jumper 120 for regulating the rotational position of the column wheel 70, an operating lever 80, and an operating lever spring 90. The column wheel 70 is composed of tooth sections 71 on the outer peripheral and pillar sections 72 provided inside the tooth sections 71, and between the adjacent pillar sections 72, there are formed gap sections 73.

The column wheel 70 is rotatably fixed to a rotation guide shaft 74 implanted to stand on a train wheel bridge 12 (see FIGS. 2 and 3) with a fixing screw 75. The column wheel 70 is limited by the column wheel jumper 120 in the position in the rotational direction.

The column wheel jumper 120 is formed of a spring section 122 extended from a main body section, and a column wheel regulating section 121 formed on the tip of the spring section 122, and is fixed to the train wheel bridge 12 with a fixing screw 123.

Further, the column wheel jumper 120 presses the column wheel regulating section 121 against the tooth sections 71, thereby regulating the rotational position of the column wheel 70. The number of pillar sections 72 of the column wheel 70 is set to a half the number of the tooth sections 71, and the tooth sections 71 are rotated in the clockwise direction by one pitch every time the operative lever 80 is operated, thus the pillar sections 72 are moved by a half pitch to move the positions of the pillar sections 72 alternately to the zero-reset state and start/stop state.

The operative lever 80 is provided with a pressed section 84 formed on the end section thereof and pressed by a button 2, a pawl section 83 formed on the opposite end to the pressed section 84 and for operating the column wheel 70, and an operation guide hole 85 formed at the center thereof, and further, provided with a operative lever spring hanger shaft 82 is implanted standing towards the surface direction. The operative guide hole 85 is attached to an operative lever shaft 81 implanted standing on the train wheel bridge 12 so that the operative lever shaft 81 inserted in the operation guide hole 85, thus the operative lever 80 moves in a range of the operation guide hole 85. The operative lever 80 is movably fixed at the operative lever shaft 81 with a fixing screw 86.

It should be noted that the operative lever 80 is returned to an initial position (the state without any operations, illustrated with a chain double-dashed line in the drawing) by an operative lever spring 90 when the operation of the button 2 is stopped.

The operative lever spring 90 is composed of a fixing section 91, a spring section 92 extended from the fixing section 91, and a operative lever engaging section 93 provided to the tip portion of the spring section 92, and is fixed to the train wheel bridge 12 with a fixing screw 94.

The operative lever engaging section 93 engages the operative lever spring hanger shaft 82 implanted standing on the operative lever 80, and pressing the operative lever 80 in the outward direction (the direction towards the initial position). Therefore, by operating the button, the operative laver spring 90 is distorted and the operative lever 80 operates the column wheel 70, and when the button 2 is released, the operative lever 80 is returned to the initial position by the elastic force of the operative spring 90.

Subsequently, a zero-reset mechanism of the present embodiment will be explained. The zero-reset mechanism is composed including a hammer operating lever 130, which operates in accordance with pushing operation of a button 3, a hammer setting lever 140 pivotally attached on the upper surface of the hammer operating lever 130, a hammer operating lever spring 200 for returning the hammer operating lever 130 to an initial state, a hammer 160 for zero-resetting chronograph display sections, a hammer control lever 150 for controlling the operation of the hammer 160, and a hammer jumper 180 for regulating the position of the hammer control lever 150 as a zero-reset member.

The hammer operating lever 130 is formed including a pressed section 134 formed on an end portion thereof and moved by being pressed by the button 3 and a hammer operating lever spring engaging section 132 formed on the opposite end thereof to the pressed section 134. On the upper surface of the hammer operating lever 130, the hammer setting lever 140 is pivotally attached with a hammer setting lever shaft 133.

Further, the hammer operating lever 130 is pivotally attached to the train wheel bridge 12 with a hammer operating lever shaft 131 in the condition in which the hammer setting lever 140 is attached thereto. It should be noted that the hammer operating lever 130 is provided with rotational force in the clockwise direction by the hammer operating lever spring 200 pressing the hammer operating lever spring engaging section 132, and when no button operation exists, the hammer operating lever 130 is in an initial position shown in FIG. 1.

The hammer setting lever 140 is provided with a column wheel engaging section 141 and a hammer control lever engaging section 142 on the both ends thereof, and is pivotally supported by the hammer setting lever shaft 133 at substantially the center portion thereof. In the start state shown in FIG. 1, the column wheel engaging section 141 of the hammer setting lever 140 is positioned at the position of a gap section 73*b* of the column wheel 70. Therefore, since the hammer setting lever 140 is in the state in which the position thereof is not regulated, the hammer setting lever 140 does not press the posterior hammer control lever 150 even if the hammer operating lever 130 is operated.

The hammer control lever 150 is provided with peninsular protrusions in three directions, one is a column wheel engaging section 152 engaged with the pillar section 72 of the column wheel 70, another is a hammer jumper engaging section 153 engaged with the hammer jumper 180, and still another protrusion is provided with a hammer operating shaft 154, which operates the hammer 160, implanted standing thereon.

The hammer control lever 150 thus configured is attached to a hammer control lever shaft 151, which is implanted to stand on the train wheel bridge 12, so that the hammer control lever shaft 151 is inserted in the hammer control lever 150, and is pivotally fixed with a fixing screw 155. Then, by engaging the hammer jumper engaging section 153 of the hammer control lever 150 with a regulating section 182*b* of the hammer jumper 180, the position of the hammer control lever 150 is regulated. Between the column wheel engaging section 152 and the pillar sections 72 of the column wheel 70, there are provided narrow gaps.

The hammer jumper 180 is provided with a main body section 183, a spring section 181 extending from the main body section 183, and the hammer control lever regulating section 182 provided to the tip portion of the spring section 181, and is fixed to the train wheel bridge 12 with a fixing screw 184. The hammer control lever regulating section 182 is provided with two regulating sections 182*a*, 182*b* each formed of a recess, and when the hammer jumper engaging section 153 of the hammer control lever 150 moves from the regulating section 182*b* to the regulating section 182*a*, by overriding a protruding section between the regulating sections 182*a*, 182*b*, the zero-resetting operation is provided with controlled motion and feeling.

The hammer operating shaft 154 implanted to stand on an end portion of the hammer control lever 150 is inserted in a hammer operating hole 166 provided to the hammer 160, and the hammer 160 is operated by the operation of the hammer operating lever 130. However, in the state shown in FIG. 1, the motion of the transmission hammer 130 is not transmitted as the operative force of the hammer setting lever 140, and the hammer 160 is not operated. Further, the column wheel engaging section 152 of the hammer control lever 150 abuts on the pillar sections 72 of the column wheel 70, and the hammer control lever 150 is never operated further.

The hammer 160 as the zero-reset member is composed of a hammer body 161 as a zero-reset member body and a minute hammer 170 as a movable lever fixed to each other. The hammer body 161 is provided with an hour counting wheel operating section 164 and a second counting wheel operating section 165 extending along the operational direction of the hammer 160 on the both sides in a substantially Y-shape. Further, the hammer body 161 is also provided with operating guide holes 163, 161*a*, and a hammer operating hole 166.

The hammer body 161 is provided with an eccentric shaft 167 as an adjustment shaft, a minute hammer guide shaft 168, and a minute hammer fixing shaft 174 implanted to stand thereon. These eccentric shaft 167, minute hammer guide shaft 168, and minute hammer fixing shaft 174 are respectively attached to an adjustment hole 171, a minute hammer fixing shaft hole 175, and a minute hammer guide hole 173 so that the eccentric shaft 167, the minute hammer guide shaft 168, and the minute hammer fixing shaft 174 are respectively inserted in the adjustment hole 171, the minute hammer fixing shaft hole 175, and the minute hammer guide hole 173, thus the hammer body 161 and the minute hammer 170 are united with a minute hammer fixing screw 176.

It should be noted that the structure of the hammer 160 will be explained in detail later with reference to FIGS. 5 and 6.

As described above, the hammer 160, which is composed of the hammer body 161 and the minute hammer 170 united with each other, is fixed at the hammer guide shaft 162 so that the hammer 160 is operable along the operation guide holes 163, 161*a* with a hammer fixing screw 177 with the operation guide holes 163, 161*a* attached to the hammer guide shafts 162, 158 implanted to stand on the train wheel bridge 12, respectively, so that the hammer guide shafts 162, 158 are inserted in the respective operation guide holes 163, 161*a*.

When the chronograph display section is in the start state, the hour counting wheel operating section 164, a minute counting wheel operating section 172, and the second counting wheel operating section 165 of the hammer 160 are distant from an hour heart 28, a minute heart 63, and a second heart 41, respectively. In other words, an hour counting wheel 25, a minute counting wheel 60, and a second counting wheel 40 are in a driving state.

Subsequently, the column wheel mechanism described above, and a mechanism for controlling start and stop of the chronograph display section in conjunction with this operating mechanism will be explained with reference to FIG. 1. In the start state, the column wheel 70 is in a state shown in FIG. 1, and an column wheel engaging section 103 of a first chronograph coupling lever 100 enters the gap section 73*a* of the column wheel 70.

The first chronograph coupling lever 100 is provided with the column wheel engaging sections 103 protruding like a peninsular in three directions, a clutch operating section 101, and a second chronograph coupling lever engaging section 104. Further, the first chronograph coupling lever 100 is pivoted by a first chronograph coupling lever shaft 102, and is pivotally fixed to the train wheel bridge 12 with a fixing screw 105. The first chronograph coupling lever 100 is pressed in a direction towards the column wheel 70 by a second chronograph coupling lever 110.

It should be noted that the surface of the first chronograph coupling lever 100 is processed with a hard carbon film process (e.g., a diamond-like carbon (DLC) process). The hard carbon film process is performed at least on a clutch operating section 101, a clutch engaging section 105 (see FIG. 3), the column wheel engaging section 103, and the second chronograph coupling lever engaging section 104 of the first chronograph coupling lever 100 using film forming means such as ion plating or plasma CVD.

The thickness of the hard carbon film process is preferably varied in accordance with the region of the first chronograph coupling lever 100. In more detail, the thickness thereof in the clutch operating section 101, the clutch engaging section 105, and the front and back planar sections is set to 1 μm, the thickness thereof in the column wheel engaging section 103, the second chronograph coupling lever engaging section 104, and other cross-sections is set to 0.5 μm. This is for obtaining sufficient film thicknesses and film adhesiveness in the regions of the first chronograph coupling lever 100 to which particular sliding property and durability (wear resistance) are required. Further, the thicknesses of the both front and back surfaces of the first chronograph coupling lever 100 are set to suitable amounts for preventing warpage caused by the film stress of the hard carbon film.

If a plasma CVD process is used as the hard carbon film process, the ratio of the thickness in the surface facing the plasma to the thickness in the surface perpendicular to the plasma becomes 2 to 1. Therefore, by performing the film formation while the surface of the first chronograph coupling lever 100 having a large planar portion is disposed to face the plasma, desired thicknesses can be obtained.

The second chronograph coupling lever 110 includes a first chronograph coupling lever engaging section 113 to be engaged with the second chronograph coupling lever engaging section 104 of the first chronograph coupling lever 100, a clutch operating section 111, and a spring section 114. Further, the second chronograph coupling lever 110 is pivotally supported by a second chronograph coupling lever shaft 112, pivotally fixed to the train wheel bridge 12 with a second chronograph coupling lever fixing screw 118, and is prevented from being lifted in the base section of the clutch operating section 111 with a limb of a second chronograph coupling lever holding shaft 116.

It should be noted that the surface of the second chronograph coupling lever 110 is also processed with the hard carbon film process.

The hard carbon film process is performed at least on a clutch operating section 111, a clutch engaging section 118, the first chronograph coupling lever engaging section 113, and an engaging section with a spring hanger shaft 115 of the spring section 114 of the second chronograph coupling lever 110 using film forming means such as ion plating or plasma CVD.

The method of forming the hard carbon film and the thickness thereof are also varied in accordance with the regions in the second chronograph coupling lever 110 similarly to the case with the first chronograph coupling lever 100. The thickness in a clutch operating section 111, a clutch engaging section 118, and the front and back planar sections is set to 1 μm, and the thickness in the first chronograph coupling lever engaging section 113 or other cross-sections is set to 0.5 μm. This is for obtaining sufficient film thicknesses and film adhesiveness in the regions of the second chronograph coupling lever 110 to which particular sliding property and durability (wear resistance) are required. Further, the thicknesses of both the front and the back surfaces of the second chronograph coupling lever 110 are set to suitable amounts for preventing warpage caused by the film stress of the hard carbon film.

The second chronograph coupling lever 110 is provided with rotational force in the counterclockwise direction by the spring section 114 engaged with the spring hanger shaft 115 implanted to stand on the train wheel bridge 12, and biases the first chronograph coupling lever 100 with rotational force in the clockwise direction via the first chronograph coupling lever engaging section 113. In the start state, since the column wheel engaging section 103 of the first chronograph coupling lever 100 enters the gap section 73*a* of the column wheel 70 as described above, the clutch operating section 101 of the first chronograph coupling lever 100 and the clutch operating section 111 of the second chronograph coupling lever 110 are separated from a clutch 44 (see also FIG. 3) attached to the second counting wheel 40 so as not to inhibit to drive the second counting wheel 40. Then, an hour CG setting lever 190 is operated in conjunction with the second chronograph coupling lever 110.

The hour CG setting lever 190 includes a spring section 192 and an hour counting wheel setting section 193, and is pivotally supported by an hour CG setting lever shaft 191, and is fixed to the train wheel bridge 12 with a setting lever fixing screw 195.

Further, the hour CG setting lever 190 is engaged with an hour CG setting lever spring hanger section 117 provided to the second chronograph coupling lever 110 in the tip portion of the spring section 192, thus moves in conjunction with operations of the second chronograph coupling lever 110. In the start state, the hour CG setting lever 190 is rotated in the clockwise direction around the hour CG setting lever shaft 191 by the second chronograph coupling lever 110. Therefore, the hour counting wheel setting section 193 is separated from the hour counting wheel 25 so as not to inhibit driving of the hour counting wheel 25.

Subsequently, the structures of the hour counting wheel 25, the minute counting wheel 60, and the second counting wheel 40 as the chronograph display mechanism will be explained.

Firstly, an hour counting wheel train from a barrel drum 20 as a driving source to the latter stage of the hour counting wheel 25 will be explained with reference to FIGS. 1 and 2.

FIG. 2 is a cross-sectional view showing the structure of the hour counting wheel train. In FIGS. 1 and 2, the hour counting wheel train is composed of a first hour counter intermediate wheel 21 for transmitting the rotation of the barrel drum 20, a second hour counter intermediate wheel 22, and the hour counting wheel 25.

The first hour counter intermediate wheel 21 is pivotally supported by a main plate 11 and the train wheel bridge 12, and a gear provided to the first hour counter intermediate wheel spindle 21*a* meshes a gear of the barrel drum 20. The first hour counter intermediate wheel spindle 21*a* protrudes above the train wheel bridge 12, and is provided with a small gear 21*b* axially supported on the tip portion thereof. The small gear 21*b* meshes the second hour counter intermediate wheel 22.

The second hour counter intermediate wheel 22 is composed of a second conveyor pinion 22*a* and a second conveyor gear 22*b*, and is pivotally supported by the train wheel bridge 12 and a oscillating weight bridge 14. The hour counting wheel 25 meshes the second conveyor gear 22*b*.

The hour counting wheel 25 is composed of an hour counting wheel spindle 26, an hour counting gear 27, a slip spring 29, and an hour heart 28, and is pivotally supported between the main plate 11 and the oscillating weight bridge 14. In detail, across a limb section 26*a* provided to the hour counting wheel spindle 26, the hour heart 28 is pivotally supported on the lower side while the hour counting gear 27 is pivotally supported on the upper side.

Further, the slip spring 29 is attached above the hour counting gear 27, and a slip spring fixing washer 29*a* is axially fixed to the hour counting wheel spindle 26 from the above.

The slip spring 29 is a plate spring, held between the hour counting gear 27 and the slip spring fixing washer 29*a*, and biases the hour counting gear 27 with predetermined elastic force. The elastic force is set so that the hour counting gear 27 and the hour counting wheel spindle 26 rotate integrally with each other in conjunction with the rotation of the barrel drum 20 while the chronograph is in operation (in the start state), and the hour heart 28 and the hour counting wheel spindle 26 rotate sliding against the hour counting gear 27 set by the hour setting lever 190 in the zero-reset operation. An hour counting hand 220 is attached to the tip portion of the hour counting wheel spindle 26. The hour counting wheel 25 makes a revolution every 12 hours.

It should be noted that at the start of the chronograph, the hour counting wheel setting section 193 of the hour CG setting lever 190 is separated from the hour counting gear 27, and the hour counting wheel operating section 164 of the hammer 160 is separated from the hour heart 28.

Subsequently, a second CG wheel train including a second counting wheel 40 and a minute CG wheel train including a minute counting wheel 60 will be explained with reference to FIGS. 1 and 3.

FIG. 3 is a cross-sectional view showing the structure of the second CG wheel train and the minute CG wheel train. The second CG wheel train 30 is composed of the second counting wheel 40 and the second CG operating wheel 31 linked with each other in a thickness direction using the second counting spindle 32 as a shaft. The second counting wheel 40 is axially fixed to the second counting spindle 32, wherein the second CG operating wheel 31 has a loose-fitting relationship with the second counting spindle 32.

The second CG operating wheel 31 is configured by stacking and fixing the second counting gear 34 and a clutch plate 35 on the second CG operating pinion 33 having a through hole at the center thereof, and the second counting spindle 32 is inserted in the second CG operating pinion 33, thus linking the second counting wheel 40 in the shaft direction. The second counting hand 221 is attached to the tip portion of the second counting spindle 32, and makes a revolution every one minute.

The second counting wheel 40 is composed of a second heart 41, a clutch 44, and a minute CG advancing pawl washer 46, and is integrally configured. The second heart 41 is provided with a tube section protruding downward at the center thereof, and the minute CG advancing pawl washer 46 is axially fixed to the tube section, and the clutch 44 is axially fixed on the further tip portion of the tube section.

The minute CG advancing pawl washer 46 is provided with a minute CG advancing pawl 42 and a minute CG advancing pawl spring 43 on the upper surface thereof, and the minute CG advancing pawl 42 can pivot thereon. Further, the minute CG advancing pawl spring 43 presses the tip of the minute CG advancing pawl 42 so as to be projected from the outer periphery of the minute CG advancing pawl washer 47.

The clutch 44 is composed of a clutch ring 45 and a clutch spring 48 fixed to each other to form an unit, and is fixed to the tip portion of the tube section of the second heart 41 with a clutch fixing washer 49. Further, the second counting wheel 40 is formed by axially fixing the second heart 41, the minute CG advancing pawl 42, and the clutch 44 by the second counting wheel spindle 32 in the condition in which the second heart 41, the minute CG advancing pawl 42, and the clutch 44 are integrated.

It should be noted that the second counting wheel 40 is pivotally supported by a center wheel bridge (not shown) for normal time display on one side (lower side), and is pivotally supported by a second wheel bridge 13 on the other side (upper side).

Since the clutch 44 is connected with friction by pressing the clutch plate 35 with the elastic force of the clutch spring 48 when driving the chronograph, the second counting wheel 40 and the second CG operating wheel 31 rotate integrally. Further, the rotation of the second counting wheel 40 is transferred to the minute CG wheel train.

The minute CG wheel train is composed of a minute counter intermediate wheel 50 and a minute counting wheel 60. The minute counter intermediate wheel 50 is composed of a minute counter intermediate gear 51 and a minute counter intermediate pinion 52, and is pivotally supported by train wheel bridge 12 and the second wheel bridge 13.

Here, explanation will be added regarding the rotation transmission from the second counting wheel 40 to the minute counter intermediate wheel 50. The minute CG advancing pawl washer 46 is attached to the second counting wheel 40, and rotates in conjunction with the second counting wheel 40. The minute CG advancing pawl washer 46 is provided with the minute CG advancing pawl 42, and makes a revolution every one minute. The minute CG advancing pawl 42 meshes the minute counter intermediate gear 51 to transmit the rotation.

As shown in FIG. 1, the minute counter intermediate gear 51 is provided with seven sets of tooth arrangements each composed of two teeth, and a space with no teeth formed is provided between the tooth arrangements. The minute CG advancing pawl 42 includes two pawls, and the minute counter intermediate wheel 50 is rotated by a set of tooth arrangement while the minute CG advancing pawl 42 makes one revolution (namely, for one minute). As described above, the minute counting wheel 60 is intermittently driven by one pitch for every one minute.

The minute counting wheel 60 is composed by axially fixing a minute counting gear 62 and a minute heart 63 by the minute counting wheel spindle 61, and is pivotally supported by the main plate 11 and the oscillating weight bridge 14. The minute counting gear 62 meshes the minute counter intermediate wheel 50 to transmit the rotational force. The minute counting gear 62 is engaged with a minute CG jumper 210.

The minute CG jumper 210 will be explained with reference to FIG. 1. The minute CG jumper 210 is provided with a minute CG jump-restraining section 212 on one end thereof and a minute CG jumper spring 213 on the other end thereof, and is pivotally supported by a minute CG jumper supporting shaft 211 at substantially the center section thereof.

The minute CG jumper spring 213 is fixed to a minute CG jumper spring shaft 214, which is implanted to stand on the minute CG jumper 210, on one end thereof, and is engaged with a minute CG jumper spring hanger shaft 215, which is implanted to stand on the train wheel bridge 12, on the other end thereof, thus pressing the minute CG jump-restraining section 212 against the teeth of the minute counting gear 62.

The minute counting gear 62 rotates by one pitch while the minute CG advancing pawl 42 makes a revolution. Here, since the minute counting gear 62, which is pressed by the minute CG jump-restraining section 212, is driven intermittently and restrainedly by one pitch for every one minute. The minute counting gear 62 has 30 teeth, and has a structure of representing 30 minutes by one revolution and 60 minutes by two revolutions. A minute counting hand 222 is attached to the tip portion of the minute counting wheel spindle 26.

Since a minute counting wheel operating section 172 of the hammer 160 (a minute hammer 170) is separated from the minute heart 63 when driving the chronograph, the minute counting wheel 60 continues driving.

As described above, the oscillating weight 15 is provided above the chronograph mechanism provided with a column wheel mechanism for controlling the three states, namely start, stop, and zero-reset of the chronograph, the operating mechanism for controlling start and stop operations, the zero-reset mechanism for controlling the zero-reset operation, and the chronograph display mechanism.

Subsequently, the operations of starting and stopping the chronograph will be explained with reference to FIGS. 1 through 3.

Firstly, the start operation of the chronograph will be explained. The start operation is performed by a holding-down operation of the button 2. An operating lever 80 pushed to be moved by the button 2 engages the tooth sections 71 of the column wheel, and rotates the column wheel 70 by one pitch of the tooth sections 71 by one operation. FIG. 1 shows this state.

In this state, the first chronograph coupling lever 100 and the second chronograph coupling lever 110 are made separate from the clutch 44 fixed to the second counting wheel 40. Further, the hour counting wheel setting section 193 of the hour CG setting lever 190 is also separated from the hour counting gear 27.

It should be noted that the hard carbon film process is provided to each of the first chronograph coupling lever 100 and the second chronograph coupling lever 110. Therefore, when the first chronograph coupling lever 100 and the second chronograph coupling lever 110 are separated from the clutch 44, in each of the sliding sections between the column wheel engaging section 103 of the first chronograph coupling lever 100 and the pillar section 70*a* of the column wheel 70, between the clutch 44 and the clutch engaging section 105 of the first chronograph coupling lever 100 or the clutch engaging section 118 of the second chronograph coupling lever 110, between the second chronograph coupling lever engaging section 104 of the first chronograph coupling lever 100 and the first chronograph coupling lever engaging section 113 of the second chronograph coupling lever 110, and between the spring section 114 of the second chronograph coupling lever 110 and the spring hanger shaft 115, the frictional resistance is reduced, thereby performing reliable operation with reduced operational force, and preventing the wear in each of the sliding sections from occurring.

Further, the hour counting wheel operating section 164, the second counting wheel operating section 165, and the minute counting wheel operating section 172 of the hammer 160 are separated from the hour heart 28, the second heart 41, and the minute heart 63, respectively. Therefore, the hour counting wheel 25, the second counting wheel 40, and the minute counting wheel 60 start driving.

Subsequently, a chronograph stopping operation will be explained. In the state of starting the chronograph, the button 2 is operated to push to move the operating lever 80, and further, the column wheel 70 is rotated by one pitch of the tooth sections 71. Since the number of pillar sections 72 is set to be a half the number of teeth of tooth sections 71, the pillar section 72 is advanced by a half pitch by advancing the tooth sections 71 by one pitch.

Therefore, the column wheel engaging section 103 of the first chronograph coupling lever 100 runs upon the side surface of the pillar section 72*a*, and rotates in the counterclockwise direction. In conjunction with the first chronograph coupling lever 100, the second chronograph coupling lever 110 rotates in the clockwise direction, and each of the clutch operating sections 101, 111 engages with the clutch 44 to separate the second counting wheel 40 and the second CG operating wheel 31 from each other (illustrated with a broken line in FIG. 3).

Further, the hour CG setting lever 190 rotates in the counterclockwise direction in conjunction with the second chronograph coupling lever 110, and the hour counting wheel setting section 193 presses the hour counting gear 27 (illustrated with a broken line in FIG. 2). Since the second hour counter intermediate wheel 22 is provided with the slip spring 23, only the second hour counter intermediate gear 22*b* rotates while sliding, but the hour counting wheel 25 stops.

It should be noted that if the operating lever 80 is operated again in the chronograph stopping state, the state is switched to the chronograph starting state to allow performing the accumulative measurement.

Further, it is possible to perform zero-reset of the chronograph display section by pushing to move the hammer operating lever by operating the button 3 in the chronograph stopping state.

Since the hard carbon film process is provided to each of the first chronograph coupling lever 100 and the second chronograph coupling lever 110, also in the chronograph stopping operation, when the first chronograph coupling lever 100 and the second chronograph coupling lever 110 engaged with the clutch 441 in each of the sliding sections between the column wheel engaging section 103 of the first chronograph coupling lever 100 and the pillar section 70*a* of the column wheel 70, between the clutch 44 and the clutch operating section 101 of the first chronograph coupling lever 100 or the clutch operating section 111 of the second chronograph coupling lever 110, and between the second chronograph coupling lever engaging section 104 of the first chronograph coupling lever 100 and the first chronograph coupling lever engaging section 113 of the second chronograph coupling lever 110, the frictional resistance is reduced, thereby performing reliable operation with reduced operational force, and preventing the wear in each of the sliding sections from occurring.

Subsequently, the zero-reset operation will be explained with reference to the drawings.

Figure 4:
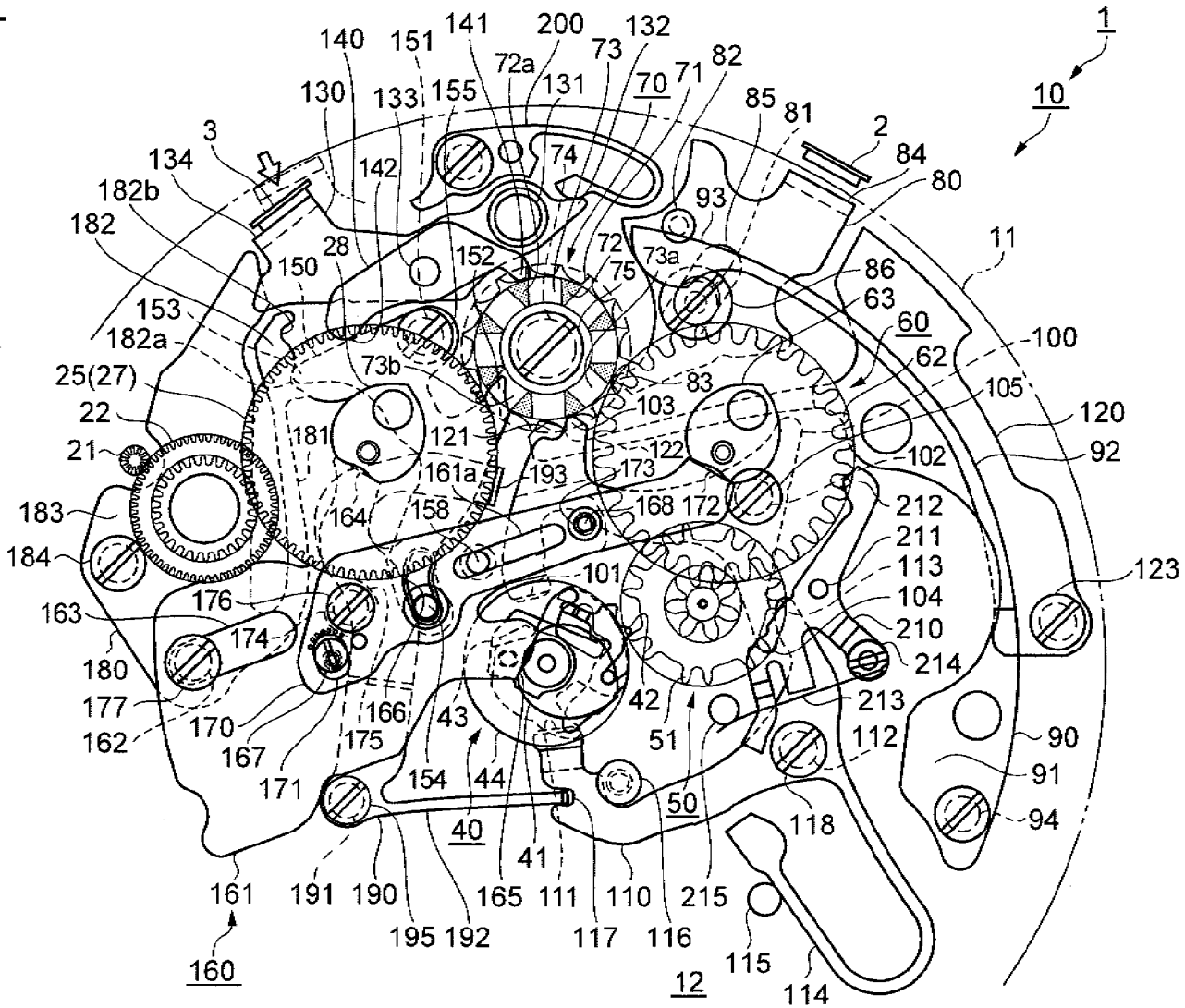
FIG. 4 is a plan view showing a zero-reset state of a chronograph mechanism according to an embodiment of the invention.

FIG. 4 is a plan view showing a zero-reset state of a chronograph mechanism according to the present embodiment. The zero-reset of the chronograph display section is performed by pushing operation of the button 3 to push to move the hammer operating lever 130 in the chronograph stopping state. In the state of stopping the chronograph, the second heart 41 and the second CG operating wheel 31 are separated in transmission by the first chronograph coupling lever 100 and the second chronograph coupling lever 110 (see FIG. 3). Further, the hour counting gear 27 of the hour counting wheel 25 is set by the hour CG setting lever 190 (see FIG. 2).

In such a state, by the pushing operation of the button 3, the hammer operating lever 130 is rotated counterclockwise around the hammer operating lever shaft 131. Then, the hammer setting lever 140 also rotates together with the hammer operating lever 130. Since the column wheel engaging section 141 abuts on the pillar section 72*a* of the column wheel 70, the hammer setting lever 140 pivots on the column wheel engaging section 141, and the hammer control lever engaging section 142 rotates the hammer control lever 150 around the hammer control lever shaft 151 in the counterclockwise direction.

Then, the hammer control lever 150 operates the hammer 160 by the hammer operating shaft 154. Here, the column wheel engaging section 152 of the hammer control lever 150 enters the gap 73*b* of the column wheel 70, and accordingly, moves the hammer 150 to the position where the hammer 160 can zero-reset the hour heart 28, the second heart 411 and the minute heart 63.

In this case, the hammer jumper engaging section 153 of the hammer control lever 150 is moved from the regulating section 182*b* to the regulating section 182*a* of the hammer jumper 180, thus the position is regulated. It should be noted that if the pushing operation of the button 3 is released, the hammer control lever 150 is rotated in the clockwise direction by the elastic force of the hammer jumper 180, and returns to the position of the regulating section 182*b*. In other words, it returns to the state before the zero-reset operation. Further, the hammer operating lever 130 is returned to the initial state (the position illustrated with a chain double-dashed line in the drawing) by the hammer operating lever spring 200.

The hammer 160 is operated substantially linearly along the hammer guide shafts 162, 158, and the hour counting wheel operating section 164, the second counting wheel operating section 165, and the minute counting wheel operating section 172 press the hour heart 28, the second heart 41, and the minute heart 63, respectively, to rotate to the zero-reset positions.

In the hour counting wheel 25, the hour counting gear 27 is set by the hour CG setting lever 190, and accordingly, the hour counting gear 27 does not rotate. However, since the slip spring 29 is provided, the hour counting wheel spindle 26, to which the hour heart 28 is axially fixed, is rotated to zero-reset the hour counting hand 220 (see FIG. 2).

Further, in the second counting wheel 40, since the clutch 44 is separated from the second CG operating wheel 31, the second counting spindle 32, to which the second heart 41 is axially fixed, rotates to zero-reset the second counting hand 221 (see FIG. 3).

Further, in the minute counting wheel 60, the minute counting wheel 60 is rotated by the zero-reset operation, the minute counting wheel spindle 61 axially fixed to the minute heart 63 rotates to zero-reset the minute counting hand 222. In this case, the minute counter intermediate wheel 50 is also rotated in conjunction with the rotation of the minute counting wheel 60. Transmission of the rotational force between the minute counter intermediate wheel 50 and the second counting wheel 40 is performed via the minute CG advancing pawl 42, and the minute advancing pawl 42 is regulated by the minute advancing pawl spring 43. Therefore, with respect to the rotational force applied from the minute counter intermediate wheel 50 side, the minute advancing pawl spring 43 is distorted, and the engagement between the minute advancing pawl 42 and the minute counter intermediate wheel 50 is released, thus the minute counting wheel 60 can independently be zero-reset.

When the operation of the button 3 is released after the zero-reset operation, since the column wheel mechanism for controlling the start, stop, and zero-reset states of the chronograph described above, the operating mechanism for controlling the start and stop operations, and the zero-reset mechanism column wheel mechanism for controlling the zero-reset operation are in the chronograph stopping state, by performing the pushing operation of the button 2 once again, it is possible to start the chronograph to start the chronograph measurement.

It should be noted that since the hard carbon film process is performed on each of the first chronograph coupling lever 100 and the second chronograph coupling lever 110, even in the zero-reset operation, the frictional resistance in the sliding section between the clutch 44 and the clutch engaging section 105 of the first chronograph coupling lever 100 or the clutch engaging section 118 of the second chronograph coupling lever 110 is reduced, thereby performing reliable operation with reduced operational force, and preventing the wear in each of the sliding sections from occurring.

It should be noted that as described above, the hammer 160 is composed of the hammer body 161 including the hour counting wheel operating section 164 and the second counting wheel operating section 16S, and the minute hammer 170 including the minute counting wheel operating section 172 integrated with each other. In the zero-reset operation, it is possible that there are caused some cases in which the zero-reset is not successful because of variations in dimensions of respective operating sections. Therefore, in the present invention, there is provided an adjusting mechanism for adjusting the position of the minute hammer 170 with respect to the hammer body 161.

Figure 5:
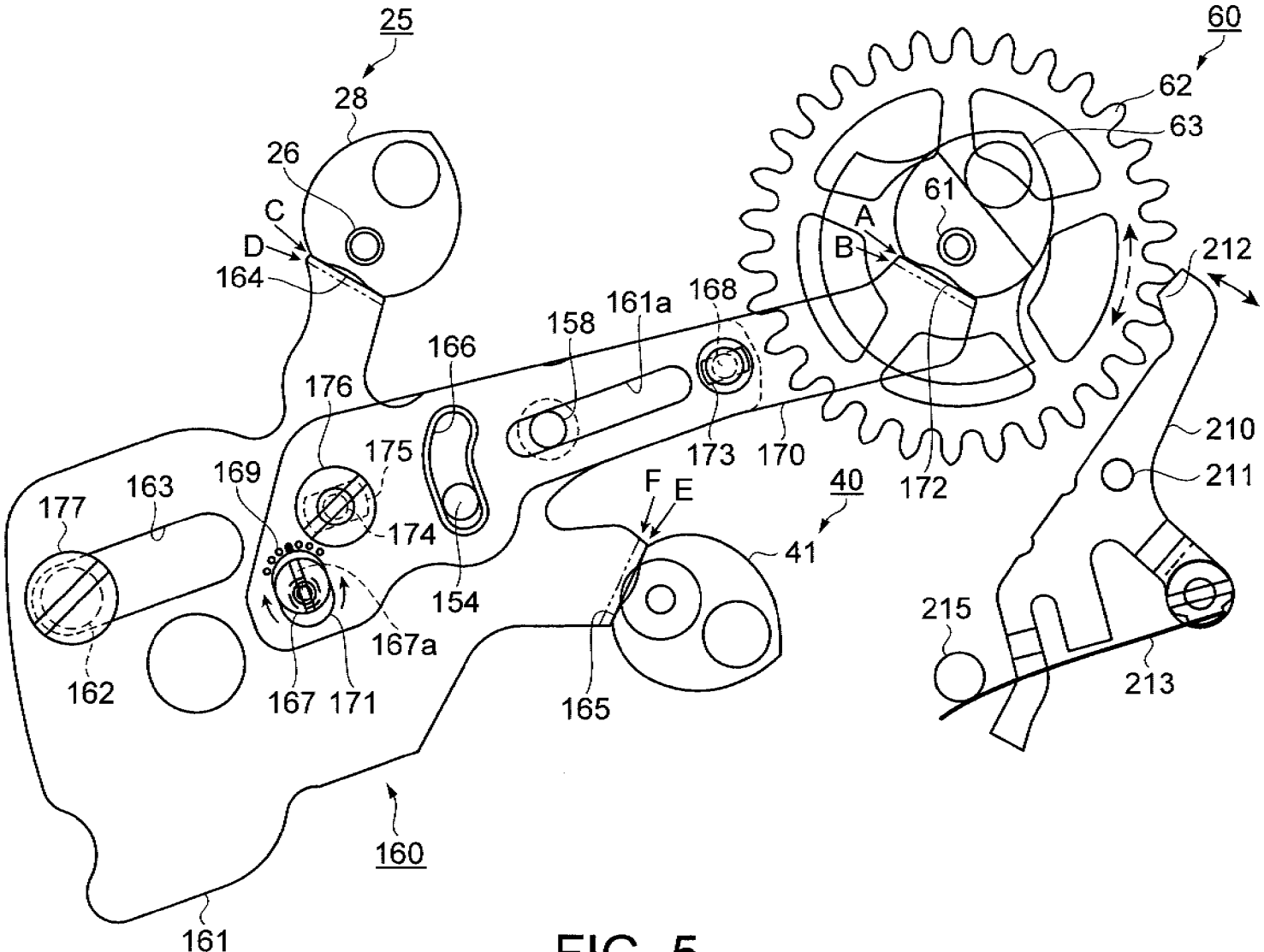
FIG. 5 is a partial plan view showing position adjustment of a minute hammer to a hammer body according to the embodiment of the invention.

FIG. 5 is a partial plan view showing the adjustment of the position of the minute hammer 170 with respect to the hammer body 161 according to the present embodiment, FIG. 6 is a partial cross-sectional view showing the cross-sectional structure thereof, FIG. 7 is an external view of the movement, and FIG. 8 is an explanatory diagram showing the method of adjustment.

Firstly, the structure of the hammer 160 will be explained. In FIGS. 5 and 6, the hammer 160 is composed of the hammer body 161 and the minute hammer 170.

The hammer body 161 is provided with the operating guide holes 161*a*, 163 opened at the positions distant from each other substantially linearly along the direction in which the hammer 160 operates. The operating guide holes 161*a*, 163 are elongate holes each having a length corresponding to the range in which the hammer 160 can operate. Further, the hour counting wheel operating section 164 and the second counting wheel operating section 165 are formed like a peninsular on both sides thereof along the direction in which the hammer 160 operates.

Further, in the middle of the operating guide holes 161*a*, 163, there is opened the hammer operating hole 166 to which the hammer operating shaft 154 implanted to stand on the hammer control lever 150 is inserted. Still further, on the both sides of the operating guide hole 161*a* and the hammer operating hole 166, there are implanted to stand thereon the minute hammer guide shaft 168, the minute hammer fixing shaft 174, and the adjusting shaft 167. The minute hammer guide shaft 168 and the minute hammer fixing shaft hole 175 are disposed on a line connecting the centers of the operating guide holes 161*a*, 163 described above.

The adjusting shaft 167 is an eccentric shaft having a shaft section and a head section eccentric to each other, and is provided with a slot 167*a* having the same direction as the eccentric direction formed on the head section.

The minute hammer 170 is provided with the minute counting wheel operating section 172 on the end portion in the longitudinal direction, and further, there are opened the minute hammer guide shaft hole 173, the minute hammer fixing shaft hole 175, and the adjusting hole 171 at positions respectively corresponding to the minute hammer guide shaft 168, the minute hammer fixing shaft 174, and the adjusting shaft 167 described above.

The minute hammer guide shaft hole 173 and the minute hammer fixing shaft hole 175 are elongate holes having a length allowing movement in the direction of the line connecting the minute hammer guide shaft 168 and the minute hammer fixing shaft 174. Further, the adjusting hole 171 is an elongate hole elongated in the direction perpendicular to the line connecting the minute hammer guide shaft hole 173 and the minute hammer fixing shaft hole 175. On the periphery of the adjusting hole 171, there is engraved a scale 169 used as a target of the rotational angle of the adjusting shaft 167.

The minute hammer 170 is attached on the upper surface of the hammer body 161. Specifically, the minute hammer guide shaft hole 173, the adjusting hole 171, and the minute hammer fixing shaft hole 175 of the minute hammer 170 are mounted corresponding to the minute hammer guide shaft 168, the adjusting shaft 167, and the minute hammer fixing shaft 174 implanted to stand on the hammer body 161, and then fixed with the minute hammer fixing screw 176. It should be noted that a plate spring 178 is held between the minute hammer 170 and the hammer body 161 (see FIG. 6).

The plate spring 178 is provided with a hole at the center thereof, and by setting the hole to the limb section of the minute hammer fixing shaft 174 so that the limb section is inserted in the hole, and screwing it up with the minute hammer fixing screw 176, the hammer body 161 and the minute hammer 170 are integrated.

Further, when mounting the minute hammer 170 on the hammer body 161, the slot 167*a* of the adjusting shaft 167 is aligned to the central engraved mark position of the scale 169.

The hammer 160 thus formed is assembled on the upper surface of the train wheel bridge 12 (see FIG. 6). The operating guide holes 163, 161*a* are attached to the hammer guide shafts 162, 158 implanted to stand on the train wheel bridge 12 so that the hammer guide shafts 162, 158 are inserted in the operating guide holes 163, 161*a*, and the hammer 160 is fixed with a hammer holding screw 177 in the state in which the hammer 160 can operate.

Subsequently, the position adjustment of the minute hammer 170 with respect to the hammer body 161 will be explained. It should be noted that the position adjustment can be performed in the final stage of the assembling process of the movement 10.

FIG. 7 is an external view of the movement 10 according to the present embodiment. In FIG. 7, the oscillating weight bridge 14 disposed on the upper layer of the movement 10 is provided with an observation hole 14*a* through which the minute hammer fixing screw 176 and the adjusting shaft 167 can be observed, and a notch section 14*b* through which the engaging section between the minute CG jump-restraining section 212 of the minute CG jumper 210 and the minute counting gear 62 can be observed. Further, the oscillating weight bridge 14 is provided with a shape allowing observation of more of the tooth sections at the different position from the notch 14*b*.

Therefore, it is possible to loose the minute hammer fixing screw 176, in the state of the movement, to operate the adjusting shaft 167 to perform the position adjustment while observing the engaging relationship between the minute CG jumper 210 and the minute counting gear 62. It should be noted that although the oscillating weight 15 is omitted in FIG. 7, the position of the oscillating weight 15 is rotationally moved to the position allowing the adjustment of the position of the minute hammer 170.

The adjustment method will be explained in more detail with reference to FIG. 8 (FIGS. 5 and 6 are also referred to). Firstly, the movement 10 is assembled. Subsequently, the zero-reset state is achieved by the zero-reset operation, the pushing operation of the hammer operating lever. Then, the minute counting gear 62 is slightly rotated from side to side using tweezers or the like. Here, whether or not the minute counting gear 62 moves from side to side is confirmed. If the minute counting gear 62 does not move, since it is conceivable that although the minute counting wheel operating section 172 of the minute hammer 170 presses the minute heart 63 to the zero-reset state (illustrated as the position A in FIG. 5), the second counting wheel operating section 165 or the hour counting wheel operating section 164 is separated from the second heart 41 or the hour heart 28 (illustrated as the position F or the position D in FIG. 5), the position adjustment of the minute hammer 170 is performed.

For performing the position adjustment of the minute hammer 170, firstly, the minute hammer fixing screw 176 is loosed, and adjusting shaft 167 is rotated in the counterclockwise direction. Then, the minute counting gear 62 is slightly rotated from side to side using tweezers or the like, and whether or not the minute counting gear 62 moves from side to side is confirmed again. By repeating this operation, the state in which the minute counting gear 62 operates is achieved.

Subsequently, after confirming that the minute counting gear 62 operates, whether or not the minute counting gear 62 jumps across the minute CG jump-restraining section 212 of the minute CG jumper 210 is confirmed by rotating the minute counting gear 62 from side to side. If it jumps, since it is conceivable that although the second counting wheel operating section 165 or the hour counting wheel operating section 164 presses the second heart 41 or the hour heart 28 (illustrated as the position E or C in FIG. 5), the minute counting wheel operating section 172 does not sufficiently press the minute heart 63 (illustrated as the position B), the position adjustment of the minute hammer 170 is performed.

The adjusting method is performed by rotating the adjusting shaft 167 as described above. In this case, since the minute counting wheel operating section 172 is thought to have a large gap from the minute heart 63, the minute counting wheel operating section 172 is adjusted so as to come closer to the minute heart 63 by rotating the adjusting shaft 167 in the clockwise direction. Further, the adjustment is repeated until the state is achieved in which the minute counting gear 62 operates, and does not jump across the minute CG jump-restraining section 212. After this state is confirmed, the minute hammer fixing screw 176 is screwed up to terminate the adjusting operation.

If the minute counting gear 62 operates and does not jump across the minute CG jump-restraining section 212 in the stage of assembling the movement, it is judged that the adjustment is not necessary.

Since the minute CG jumper 210 regulates the rotational position of the minute counting gear 62 in the range of a half pitch, if the minute counting gear 62 is in a range of the state in which the minute counting gear 62 does not jump across the minute CG jump-restraining section 212, even in the state in which a slight gap exists between the minute counting wheel operating section 172 and the minute heart 63, the minute counting wheel 60 can be regulated in the zero-reset position by the bias force of the minute CG jumper 210.

Therefore, according to the embodiment described above, since the three kinds of chronograph display sections, namely the second counting wheel 40 (the second counting hand 221), the minute counting wheel 60 (the minute counting hand 222), and the hour counting wheel 25 (the hour counting hand 220) are zero-reset by the hammer 160 configured as a unit, the number of components can dramatically be reduced in comparison with the prior art described above. Further, since the components for controlling the operation of the hammer 160 can also reduced, the structure can be simplified, thus the significant cost reduction can be realized.

Further, in the case in which three chronograph display sections for displaying time measurement results such as second unit, minute unit, and hour unit, and the zero-reset is performed by a single hammer 160, it is conceivable that because of the manufacturing variations in the dimensions of each of the second counting wheel operating section 165, the minute counting wheel operating section 172, and the hour counting wheel operating section 164 to the three kinds of chronograph display sections of the second counting wheel 40 (second counting hand 221), the minute counting wheel 60 (the minute counting hand 222), and the hour counting wheel 25 (the hour counting hand 220), the zero-reset of the three chronograph display sections cannot successfully be performed. Here, by providing the adjusting mechanism to the minute hammer 170, with respect to the positional relationship between other of the hour counting wheel operating section 164 and the second counting wheel operating section 165, and corresponding chronograph display sections, the position of the minute counting wheel operating section 172 can be adjusted, therefore, the zero-reset of the three chronograph display sections can be simultaneously and accurately performed.

Further, the position of the minute hammer 170 can be adjusted by loosing the minute hammer fixing screw 176, and the position can be fixed by tightening the minute hammer fixing screw 176, therefore the position adjustment can easily be performed.

Further, since the position adjustment of the minute hammer 170 is performed by rotating the adjustment shaft 167, fine position adjustment can easily be performed.

Further, by providing the plate spring 178 between the hammer body 161 and the minute hammer 170, even when the minute hammer fixing screw 176 is loosed, the position of the minute hammer 170 can be held by the elastic force of the plate spring 178 after the position adjustment and before the minute hammer fixing screw 176 is tightened to fix the position, position shift does not occur, thus the accurate adjustment to the desired position can be achieved.

Further, the minute counting wheel operating section 172 provided to the minute hammer 170 is disposed between the hour counting wheel operating section 164 and the second counting wheel operating section 165 disposed along the moving direction of the hammer 160 outside of both sides directions, the hour counting wheel operating section 164 and the second counting wheel operating section 165 disposed on the both sides can be used as the reference of the position adjustment, therefore, the adjustment range can be reduced, and the adjustment mechanism can be downsized.

Further, by performing the position adjustment of the minute hammer 170 in the final assembling process of the movement, the posture of the adjustment section is stabilized to make the adjustment operation easy, and further, the adjustment including the influence of the variation in the dimension of other components than the zero-reset mechanism becomes possible.

It should be noted that the invention is not limited to the embodiments described above but includes modifications and improvements in a range where the advantages of the invention can be achieved.

For example, although in the embodiments described above, the explanations are presented by exemplifying the structure in which the three chronograph display sections, namely the hour counting wheel 25, the minute counting wheel 60, and the second counting wheel 40, the number of the chronograph display sections is not limited to three, but can be more than three.

In the structure including tentatively four chronograph display sections, it is possible to add the adjustment mechanism to the counting wheel operating section positioned inside using the counting wheel operating sections on both sides in the operation direction of the hammer as the reference.

Further, in such a case, by providing two or more of adjustment mechanism, the object of the invention can be achieved.

Therefore, according to the embodiment described above, the chronograph watch, which makes it possible to perform accurate zero-reset of a plurality of elapsed time display sections, and to reduce the number of components to simplify the structure and enhance the manufacturing efficiency, can be provided.

The invention claimed is:

1. A chronograph watch having a movement including a plurality of elapsed time display sections distant from each other in a planar direction, said chronograph watch comprising:

a single zero-reset member for substantially simultaneously and mechanically zero-resetting the plurality of elapsed time display sections, the zero-reset member including first and second zero-reset operating sections for zero-resetting respective elapsed time display sections, at least one of the first and second zero-reset operating sections being provided to the zero-reset member, and including an adjusting mechanism for adjusting a position with respect to the corresponding elapsed time display section, the zero-reset member including a movable lever having the first zero-reset operating section at a position which is adjustable by the adjusting mechanism, and a zero-reset member body having the second zero-reset operating section, the zero-reset member body and the movable lever being fixed to each other by a movable lever fixing screw, and the adjusting mechanism including an eccentric shaft for adjusting a position of the movable lever with respect to the second zero-reset operating section, the movable lever having a first main surface facing the zero-resetting member body, the zero-resetting member body having a second main surface facing the movable lever, the zero-reset member including an elastic member between the first main surface and the second main surface, a position of the movable lever in a planar direction with respect to the zero-reset member body being maintained by elastic force of the elastic member, when the movable lever fixing screw is loosed.

2. The chronograph watch according to claim 1, wherein by taking the first and second zero-reset operating sections disposed outside in both sides to a moving direction of the zero-reset member as a reference, the adjusting mechanism is provided to the movable lever disposed between the first and second zero-reset operating sections.

3. The chronograph watch according to claim 1, wherein the adjusting mechanism and a part of the elapsed time display sections corresponding to the zero-reset operating sections provided to the movable lever are disposed so as to be observed from a direction of one of the surfaces of the movement.

* * * * *

UNITED STATES PATENT AND TRADEMARK OFFICE

CERTIFICATE OF CORRECTION

PATENT NO. : 7,614,782 B2
APPLICATION NO. : 11/713080
DATED : November 10, 2009
INVENTOR(S) : Eiichi Hiraya et al.

It is certified that error appears in the above-identified patent and that said Letters Patent is hereby corrected as shown below:

On the Title page change the listing of [75] Inventors from

"[75] Inventors: Eiichi Hiraya, Shiojjri-shi (JP);
Kazunari Agesawa, Matsumoto-shi (JP)"

to

-- [75] Inventors: Eiichi Hiraya, Shiojiri-shi (JP);
Kazunari Agesawa, Matsumoto-shi (JP) --

Signed and Sealed this

Second Day of February, 2010

David J. Kappos

David J. Kappos
*Director of the United States Patent and Trademark Office*